US011044556B2

(12) United States Patent
Hera et al.

(10) Patent No.: US 11,044,556 B2
(45) Date of Patent: Jun. 22, 2021

(54) SYSTEMS AND METHODS FOR CANCELING ECHO IN A MICROPHONE SIGNAL

(71) Applicant: Bose Corporation, Framingham, MA (US)

(72) Inventors: Cristian M. Hera, Lancaster, MA (US); Elie Bou Daher, Marlborough, MA (US); Tobe Z. Barksdale, Bolton, MA (US); Vigneish Kathavarayan, Marlborough, MA (US); Ankita D. Jain, Westborough, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/456,570

(22) Filed: Jun. 28, 2019

(65) Prior Publication Data

US 2020/0413191 A1 Dec. 31, 2020

(51) Int. Cl.
*H04R 3/02* (2006.01)
*G10L 21/0208* (2013.01)

(52) U.S. Cl.
CPC ..... *H04R 3/02* (2013.01); *G10L 21/0208* (2013.01); *G10L 2021/02082* (2013.01)

(58) Field of Classification Search
CPC .... H04R 3/02; H04R 2410/05; H04R 1/1083; H04M 9/082; H04M 3/002; H04M 2203/509; H04M 9/08; G10L 21/0208; G10L 2021/02082; G10L 2021/02165; G10L 21/0216; G10L 25/78; G10L 21/02; G10L 19/26; G10L 21/0272; G10L 25/84
USPC ..... 381/71.1, 92, 317, 71.11; 379/406.01; 704/233, E21.002, 214
See application file for complete search history.

(56) References Cited

U.S. PATENT DOCUMENTS

| | | | | |
|---|---|---|---|---|
| 7,672,445 | B1 * | 3/2010 | Zhang | H04M 9/082 370/286 |
| 2004/0174991 | A1 * | 9/2004 | Hirai | H04M 9/082 379/406.08 |
| 2014/0056435 | A1 * | 2/2014 | Kjems | H04M 9/082 381/66 |

* cited by examiner

*Primary Examiner* — Norman Yu
(74) *Attorney, Agent, or Firm* — Bond, Schoeneck & King, PLLC

(57) ABSTRACT

An audio system, including an echo canceler being configured to receive a first reference signal and a microphone signal, and to minimize an echo signal of the microphone signal, according to the first reference signal, the echo signal being a component of the microphone signal correlated to the first reference signal, to produce a residual signal; a post filter configured to receive a second reference signal and the residual signal, and to suppress at least one residual component correlated to the second reference signal, according to the second reference signal, to produce an estimated voice signal, wherein the first reference signal is received from a first location of an audio processing chain and the second reference signal is received from a second location of the audio processing chain, the first location and the second location being separated by at least one audio processing module of the audio processing chain.

19 Claims, 8 Drawing Sheets

SYSTEMS AND METHODS FOR CANCELING ECHO IN A MICROPHONE SIGNAL

BACKGROUND

The present disclosure generally relates to systems and methods for canceling echo in a microphone signal.

SUMMARY

All examples and features mentioned below can be combined in any technically possible way.

According to an aspect, an audio system includes an echo canceler being configured to receive a first reference signal and a microphone signal, and to minimize an echo signal of the microphone signal, according to the first reference signal, the echo signal being a component of the microphone signal correlated to the first reference signal, to produce a residual signal; and a post filter configured to receive a second reference signal and the residual signal, and to suppress at least one residual component correlated to the second reference signal, according to the second reference signal, to produce an estimated voice signal, wherein the first reference signal is received from a first location of an audio processing chain and the second reference signal is received from a second location of the audio processing chain, the first location and the second location being separated by at least one audio processing module of the audio processing chain.

The audio system of claim 1, wherein the first reference signal is one of a first plurality of reference signals received by the echo canceler, wherein the second reference signal is one of a second plurality of reference signals received by the post filter, wherein the first plurality of reference signals comprises fewer signals than the second plurality of reference signals.

According to an example, the first reference signal is one of a first plurality of reference signals received by the echo canceler, wherein at least one reference signal of the first plurality of reference signals is separated from the first reference signal by at least one processing module of the audio processing chain.

According to an example, the second reference signal is one of a second plurality of reference signals received by the post filter, wherein at least one reference signal of the second plurality of reference signals is separated from the second reference signal by at least one processing module of the audio processing chain.

According to an example, the first reference signal is a summation of a first plurality of signals of the audio processing chain, wherein the summation occurs outside of the audio processing chain.

According to an example, at least one of the first plurality of signals is separated from at least one other signal of the first plurality of signals by at least one audio processing module of the audio processing chain.

According to an example, the second reference signal is a summation of a second plurality of signals of the audio processing chain, wherein the summation occurs outside of the audio processing chain.

According to an example, at least one of the second plurality of signals is separated from at least one other signal of the second plurality of signals by at least one audio processing module of the audio processing chain.

According to another aspect, a method for cancelling echo in an audio system includes receiving, at an echo canceler, a first reference signal and a microphone signal minimizing, with the echo canceler, an echo signal of the microphone signal, according to the first reference signal, the echo signal being a component of the microphone signal correlated to the first reference signal, to produce a residual signal; receiving at a post filter, a second reference signal and the residual signal; and suppressing, with the post filter, at least one residual component correlated to the second reference signal, according to the second reference signal, to produce an estimated voice signal, wherein the first reference signal is received from a first location of an audio processing chain and the second reference signal is received from a second location of the audio processing chain, the first location and the second location being separated by at least one audio processing module of the audio processing chain.

According to an example, the first reference signal is one of a first plurality of reference signals received by the echo canceler, wherein the second reference signal is one of a second plurality of reference signals received by the post filter, wherein the first plurality of reference signals comprises fewer signals than the second plurality of reference signals.

According to an example, the first reference signal is one of a first plurality of reference signals received by the echo canceler, wherein at least one reference signal of the first plurality of reference signals is separated from the first reference signal by at least one processing module of the audio processing chain.

According to an example, the second reference signal is one of a second plurality of reference signals received by the post filter, wherein at least one reference signal of the second plurality of reference signals is separated from the second reference signal by at least one processing module of the audio processing chain.

According to an example, the first reference signal is a summation of a first plurality of signals of the audio processing chain, wherein the summation occurs outside of the audio processing chain.

According to an example, at least one of the first plurality of signals is separated from at least one other signal of the first plurality of signals by at least one audio processing module of the audio processing chain.

According to an example, the second reference signal is a summation of a second plurality of signals of the audio processing chain, wherein the summation occurs outside of the audio processing chain.

According to an example, at least one of the second plurality of signals is separated from at least one other signal of the second plurality of signals by at least one audio processing module of the audio processing chain.

According to another aspect, an audio system includes an echo canceler being configured to receive a first reference signal and a microphone signal, and to minimize an echo signal of the microphone signal, according to the first reference signal, the echo signal being a component of the microphone signal correlated to the first reference signal, to produce a residual signal; and a post filter configured to receive a second reference signal and the residual signal, and to suppress at least one residual component correlated to the second reference signal, according to the second reference signal, to produce an estimated voice signal, wherein at least one of the first reference signal or the second reference signal is a summation of a plurality of signals of an audio processing chain, wherein the summation occurs outside of the audio processing chain.

According to an example, the echo canceler receives a first plurality of reference signals, wherein at least one reference signal of the first plurality of reference signals is separated from at least one other reference signal of the first plurality of reference signals by at least one audio processing module of the audio processing chain.

According to an example, the post filter receives a second plurality of reference signals, wherein at least one reference signal of the second plurality of reference signals is separated from at least one other reference signal of the second plurality of reference signals by at least one audio processing module of the audio processing chain.

According to an example, at least one signal of the plurality of signals is separated from at least one other of signal of the plurality of signals by at least one audio processing module of the audio processing chain.

The details of one or more implementations are set forth in the accompanying drawings and the description below. Other features, objects, and advantages will be apparent from the description and the drawings, and from the claims.

DETAILED DESCRIPTION

Figure 1:
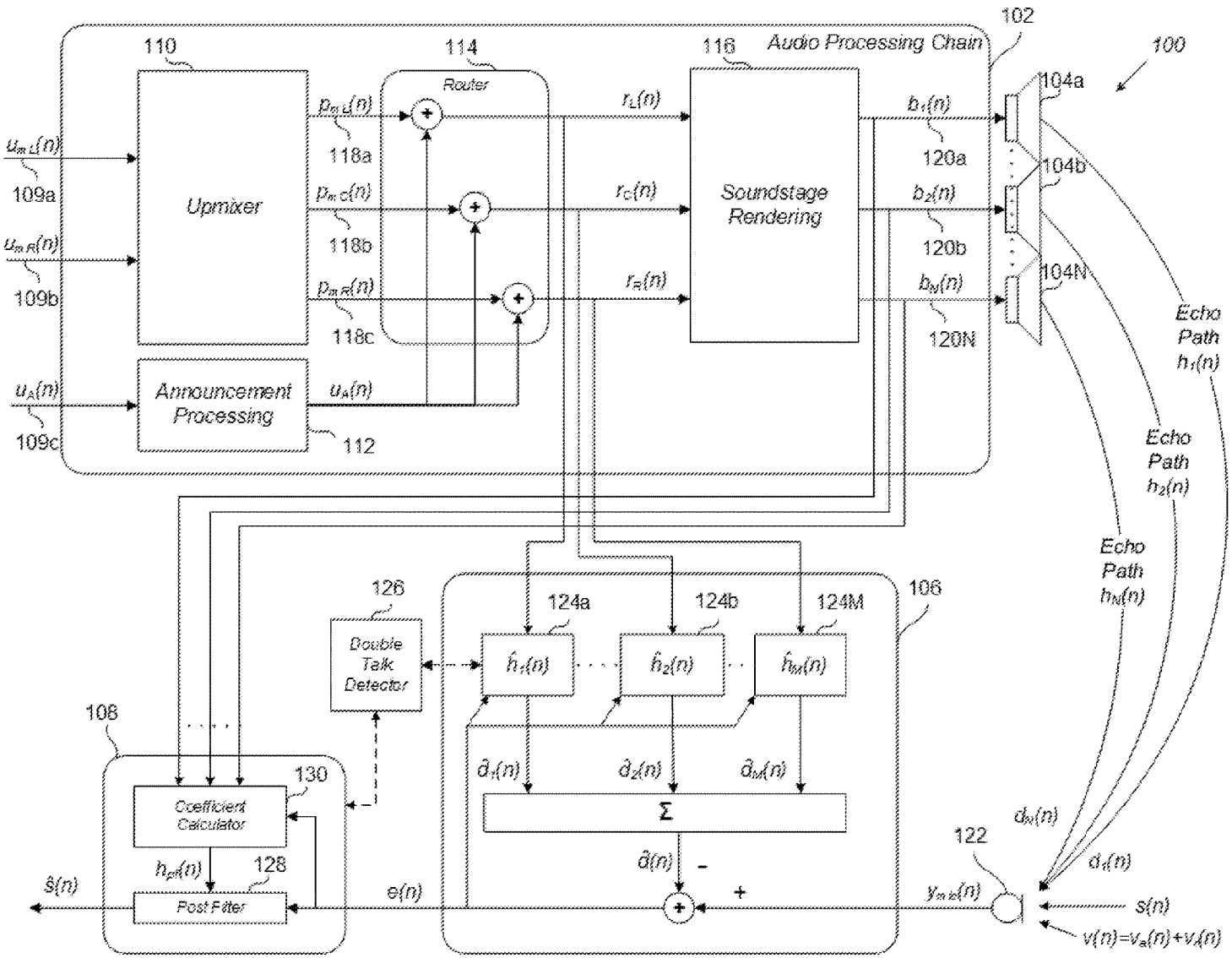
FIG. 1 depicts a schematic of an audio system including an echo canceler and post filter being referenced to signals taken at different locations of an audio processing chain, according to an example.

There is shown in FIG. 1 an audio system 100 including an audio processing chain 102 configured to condition one or more received program content signals u(n) for transduction by one or more acoustic transducers 104. In an example the audio system 100 may be implemented in a vehicle, although audio system 100 may be implemented in any setting in which an echo canceler 106 and post filter subsystem 108 are used to reduce an echo component of a microphone signal.

The program content signals u(n) may be a single type of program content signal, such as a music signal, presented over multiple channels 109 (e.g., channel 109*a* and channel 109*b*) as, for example, a left and right pair. Alternatively, or in combination, multiple types of program content signals u(n), such as voice, navigation, or music, may each be presented over one or more channels 109. In the example of FIG. 1, a music program content signal $u_m(n)$ is received as a left and right pair $u_{mL}(n)$, $u_{mR}(n)$ over channels 109*a* and 109*b*, and an announcement signal $u_a(n)$ (e.g., voice navigation, digital assistant, lane-departure warning, or voice signal) is received over channel 109*c*. It should be understood that the program content signals u(n) shown in FIGS. 1-8 are merely provided as examples of the kinds of program content signals u(n) that could be received, and that in alternative examples, any number of program content signals u(n) of various kinds may be received at audio system 100. The program content signals u(n) may be analog or digital signals and may be provided as compressed and/or packetized streams. Additional information may be received as part of such a stream, such as instructions, commands, or parameters from another system for control and/or configuration of additional processing such as soundstage rendering 116, or other components. (The argument n, in this disclosure, is representative of a discrete-time signal.)

The program content signals u(n) are converted into an acoustic signal by the one or more acoustic transducers 104. In an example, one or more acoustic transducers 104 may be disposed within the vehicle cabin, each of the acoustic transducer(s) 104 being located within a respective door of the vehicle and configured to project sound into the vehicle cabin. Alternatively, or additionally, acoustic transducers 104 may be located within a headrest or elsewhere in the vehicle cabin.

The audio processing chain 102 may include one or more audio processing modules that perform various functions for conditioning the program content signals u(n), such as upmixing, downmixing, routing, equalization, and/or mixing, although other suitable functions, consistent with conditioning the program content signals for transduction by acoustic transducer 104, may be performed by audio processing chain 102. Each audio processing module in the processing chain may receive an input signal, being one or more of the program content signals u(n) and/or an output from a different audio processing module of the audio processing chain 102. Each audio processing module may apply certain audio processing to the input signal, and output an output signal to another audio processing module or to the acoustic transducers 104. The output signals of each of the audio processing modules will be correlated, in some measure, to at least one of the program content signals.

One example of the processing modules is shown in FIG. 1, in which the audio processing chain includes an upmixer 110, announcement processing 112, a router 114, and soundstage rendering 116. Upmixer 110, as shown, may receive one or more program content signals u(n) and upmix the received program content signal(s) into a greater number of output upmixed signals p(n) on upmixer output channels 118. Generally, upmixer 110 may output a set of output upmixed signals p(n) that will be routed to different groups of acoustic transducer(s) 104. For example, as shown in FIG. 1, upmixer 110 may upmix the left and right music program content signal $u_{mL}(n)$, $u_{mR}(n)$ into a left upmixed signal $p_{mL}(n)$, a center upmixed signal $p_{mC}(n)$, and a right upmixed signal $p_{mR}(n)$, on upmixed channels 118, to be routed to left, center, right, groups of acoustic transducers 104, respectively. While the upmixer 110 shown in FIG. 1 is a 3.0 upmixer (that is, upmixer 110 outputs left, right, and center output signals), it should be understood that in various alternative examples, upmixer 110 may output any number of output signals, from any number of input signals, as is suitable for the context in which audio system 100 is employed. In the example of FIG. 1 each of the upmixed program content signals p(n) is routed to at least one acoustic transducer 104, via router 114, soundstage rendering 116, and, in various alternative examples, any other intervening audio processing modules.

In the example of FIG. 1, announcement processing 112, together with router 114, may route the announcement program content signal $u_a(n)$ to one or more of the upmixed channels 118*a*, to be summed with one or more upmixed signals p(n), and to be output as output routed signals r(n). For example, if announcement program content signal $u_a(n)$ is a lane-departure warning, the announcement program content signal $u_a(n)$ may be routed to the side of the left or right side of the vehicle cabin, depending on which side the vehicle is departing the lane. Thus, if the vehicle is departing the lane on the left side, the announcement program content signal $u_a(n)$ (which, when transduced, may be a beep or other warning signal) may be routed only to the upmix channel 118*a* that is, summed with the left upmixed signal $p_{mL}(n)$, to be outputted as left routed signal $r_L(n)$, which will be eventually routed to one or more acoustic transducers 104 disposed on the left side of the vehicle cabin. Conversely, if the vehicle is departing the lane on the right side, the announcement program content signal $u_a(n)$ may be summed with right upmixed signal $p_{mR}(n)$ to eventually be routed to one or more acoustic transducers disposed on the right side of the vehicle cabin. Similarly, if announcement processing signal $u_a(n)$ is a voice signal, the announcement processing signal $u_a(n)$ may, for example, be routed to all the upmixed channels 118 to be routed to all acoustic transducers 104 in the vehicle cabin.

The router 114 output signals r(n) may be received at soundstage rendering 116, which equalizes and performs additional routing to drive the acoustic transducers 104. Because soundstage rendering 116 routes signals b(n) to each acoustic transducer 104, the output of soundstage rendering will typically include the greatest number of channels 120 (e.g., twenty output channels 120) of the audio processing chain 102. Although, the example of FIGS. 1-8 depict three output channels 120, three upmixed channels 118, and three program content channels 109, it should be understood that these are merely provided as examples, and that, in various alternative examples, any number of output channels 120, upmixed channels 118, and program content channels 109, may be provided, as is suitable for the particular context of audio processing chain 102. For example, in one example, there may be three program content channels 109, eight upmixed channels 118, and twenty output channels 120. It should also be understood that, while the number of channels typically increases along the audio processing chain 102, that is not strictly necessary, and an earlier part of audio processing chain 102 may include more channels than a latter part of the audio processing chain 102. Indeed, it should be understood that the number of channels shown are provided merely as examples and are a result of the kinds of audio processing implemented by upmixer 110, router 114, and soundstage rendering 116. Thus, various alternative examples, using the same kind of audio processing modules, or using different kinds of audio processing modules, audio processing chain 102 may include different numbers of channels at different stages of the audio processing chain 102.

A microphone, such as microphone 122, may receive each of: an acoustic voice signal s(n) from a user, a noise signal v(n), an acoustic echo signal d(n) and other acoustic signals such as background noise within the vehicle. The microphone 122 converts acoustic signals into, e.g., electrical signals, and provides them to the echo canceler 106. Specifically, microphone 122 provides a voice signal s(n), when a user is speaking, a noise signal v(n) at least when the vehicle is moving, and an echo signal d(n), (i.e., the component of the combined signal that results from the acoustic production of the acoustic transducer(s) 104) when acoustic transducers 104 are active, as part of a combined signal $y_{mic}(n)$ to the echo canceler 106. The acoustic noise signal v(n), will include, at least, components related the road noise, $v_a(n)$ (i.e., the acoustic signals within the vehicle cabin that result from the structure of the vehicle vibrating as the vehicle travels over a road) and wind noise, $v_r(n)$ (i.e., the acoustic signals within the vehicle cabin that result from air passing over the vehicle as the vehicle travels).

In some examples, the microphone 122 may be an array of microphones, having array processing to, e.g., steer beams toward sources of desired acoustic signals and/or away from noise sources, and may additionally or alternately steer nulls toward noise sources. Alternatively, or additionally, any processing associated with microphone(s) 122 may virtually project the microphone(s) 122 at a location near the user's mouth.

As mentioned above, audio system 100 may include an echo canceler 106 and a post filter subsystem 108. The echo canceler 106 generally operates to minimize the echo present in the microphone 122 to produce a residual signal e(n). Post filter subsystem 108 generally operates to suppress residual echo present in the residual signal e(n) to produce an estimated voice signal s(n). (Echo canceler 106 and post filter subsystem 108 will be discussed in detail below.) The echo canceler 106 and the post filter subsystem 108 may each be referenced to signals of audio processing chain 102 correlated to the program content signals u(n)

The effectiveness of the echo canceler 106 and the post filter subsystem 108 may be optimized: by using different reference signals for the echo canceler 106 and the post filter subsystem 108; by using for one or both of the echo canceler 106 and post filter subsystem 108, reference signals taken at different locations along the audio processing chain 102; by summing together one or more signals of the audio processing to create a single reference signal for one of the echo canceler 106 or the post filter subsystem 108; or by some combination thereof. Each of these options for optimizing the performance of audio system 100 will be described below.

Figure 2:
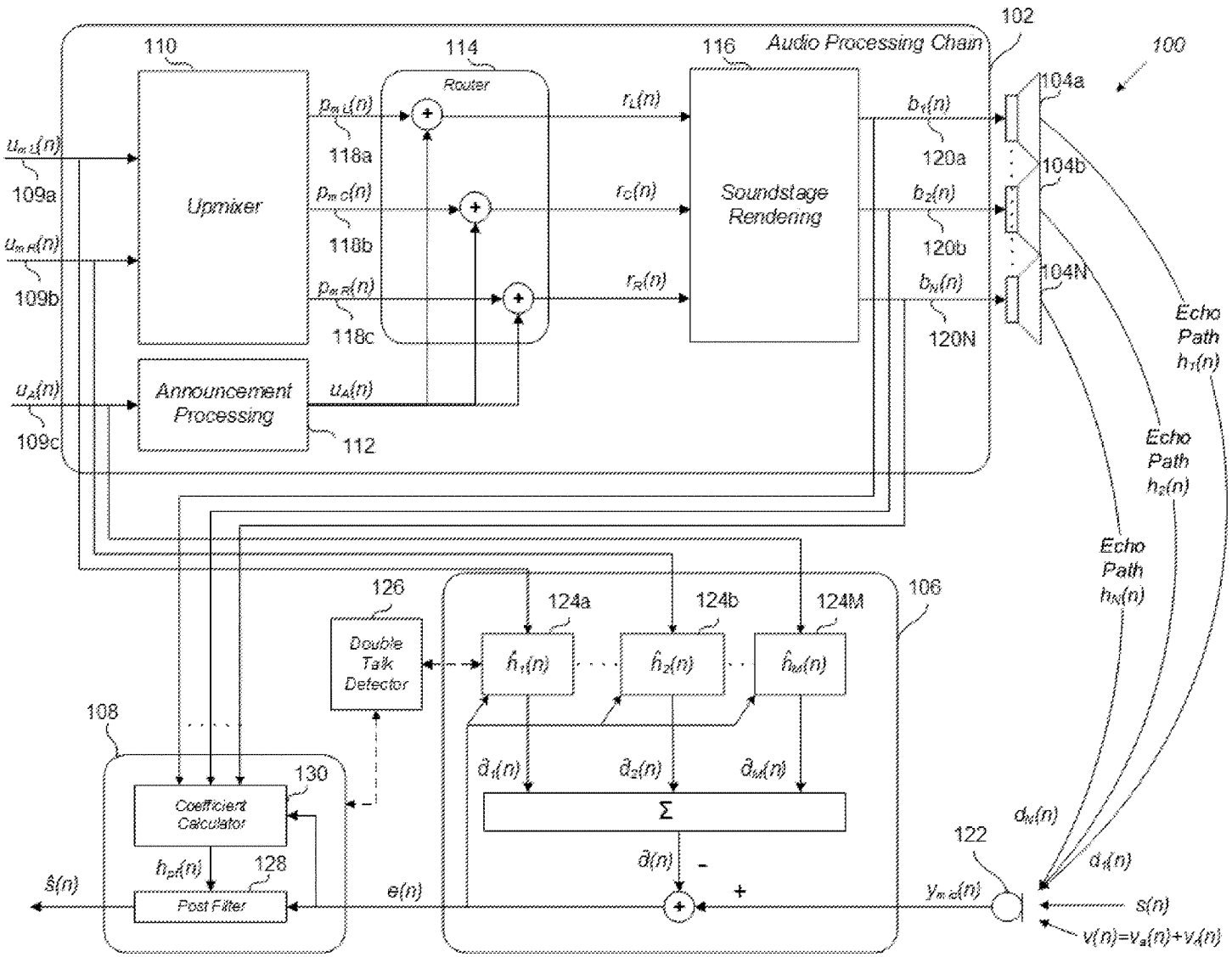
FIG. 2 depicts a schematic of an audio system including an echo canceler and post filter being referenced to signals taken at different locations of an audio processing chain, according to an example.

For example, as shown in FIGS. 1 and 2, the echo canceler 106 and the post filter subsystem 108 may be referenced to signals taken from different locations of the audio processing chain 102 in order to optimize the performance of the audio system 100. Stated differently, the reference signals of the echo canceler 106 and the post filter subsystem 108 may be signals of audio processing chain 102 separated by at least one processing module of the audio processing chain 102, in order to optimize the effectiveness of each.

Again, optimization of the audio system 100 may take into account the respective effectiveness of the echo canceler 106 and the post filter subsystem 108. Indeed, which signals of the audio processing chain 102 are used as reference signals of the echo canceler 106 and post filter subsystem 108 will be specific to the context of the particular audio processing chain 102 implemented. However, several considerations will generally inform which signals of the audio processing chain 102 are used as reference signals for the echo canceler 106 and which signals are used as reference signals for the post filter subsystem 108.

For example, the effectiveness of both echo canceler 106 and the post filter subsystem 108 will generally improve the more qualitatively similar the reference signals are to the output signals of the audio processing chain 102, that is, the signals b(n) output to acoustic transducers 104. Because audio processing chain 102 typically applies a sequential set of processes to a given set of input program content signals u(n), the effectiveness of the echo canceler 106 and post filter subsystem 108 will generally improve if the reference signals are taken closer to the output of audio processing chain 102. Stated differently, the effectiveness of the echo canceler 106 and post filter subsystem 108 generally improve as the number of processing modules separating the location from which reference signal is taken from the output of the audio processing chain 102, decreases. This is particularly true of the post filter subsystem 108, which is configured to cancel non-linearities in the microphone signal. Such non-linearities are typically present further down the audio processing chain 102, and thus the effectiveness of the post filter subsystem 108 subsystem is typically improved by receiving reference signals taken from a location nearer to the end of audio processing chain 102 (e.g., signals b(n) at the output of audio processing chain 102).

The effectiveness of the echo canceler 106 and post filter subsystem 108 may, however, decrease as the number of reference signals increases, as the echo canceler 106 and post filter subsystem 108 generally take longer to converge as the number of reference signals increases. This is particularly true of the echo canceler 106, as it operates in the time domain; whereas, post filter subsystem 108, which typically operates in the frequency domain, is not as affected by the number of reference signals used.

Thus, to optimize the audio system 100, the locations of the audio processing chain 102 from which the reference signals of the echo canceler 106 and the post filter subsystem 108 are taken, should balance the qualitative nearness of the reference signals to the output signals b(n) with the number of reference signals at a given location. Generally speaking, because the post filter subsystem 108 is particularly more effective as the reference signals include more non-linearities, and because it is not as affected by the number of reference signals used, the post filter subsystem 108 effectiveness is optimized by receiving reference signals taken at a location disposed further down audio processing chain 102 than the echo canceler 106. Conversely, the echo canceler 106, being more affected by the number of reference signals, is generally optimized by receiving reference signals taken at locations earlier in the audio processing chain 102, where there are generally fewer signals. (These are presented merely as guidelines, and will depend on the nature of audio processing chain 102.)

Examples of audio systems 100 in which the post filter subsystem 108 receives reference signals taken further down the audio processing chain 102 are shown in FIGS. 1 and 2. (Stated differently, the reference signals of post filter subsystem 108 are separated from the output by fewer processing modules than the reference signals of the echo canceler.) As shown in FIG. 1, the post filter subsystem 108 receives the audio processing chain 102 output b(n) as reference signals, while the echo canceler 106 receives the output r(n) of router 114 as reference signals. Similarly, in FIG. 2, the post filter subsystem 108 again receives the audio processing chain b(n) output as reference signals, while the echo canceler 106 receives program content signals u(n). Although FIGS. 1 and 2 depict three reference signals received from each location, it should be understood that there will typically be fewer program content signals u(n) than router output signals r(n), and there will typically be fewer router output signals r(n) than output signals b(n). Thus, in the examples of FIG. 1 and FIG. 2, the echo canceler 106 typically receives fewer reference signals than the post filter subsystem 108, allowing echo canceler 106 to converge relatively quickly. Furthermore, in both examples of FIG. 1 post filter subsystem 108 is referenced to the output of audio processing chain 102, where the presence of non-linearities is typically greatest; thus improving the effectiveness of post filter subsystem 108.

It should be understood that FIGS. 1 and 2 are merely examples of the locations from which the reference signals of echo canceler 106 and post filter subsystem 108 may be taken. In various other examples, post filter subsystem 108 may use the router output signals r(n), while the echo canceler uses the program content signals u(n) or the output signals b(n) as reference signals. Similarly, the post filter subsystem 108 may use program content signals u(n) while the echo canceler uses the router output signals r(n) or the output signals b(n). Again, which signals are used for each will be dependent, at least in part, on the kind of processing and number of outputs of each processing module.

Furthermore, it should be understood that the audio processing chain 102 may include different and/or additional processing modules, which will implement different and/or additional processing. A person of ordinary skill in the art will understand, in conjunction with a review of this disclosure, the locations from which the reference signals should be taken, in order to optimize the effectiveness of the echo canceler 106 and post filter subsystem 108 will depend on the nature of processing modules of which the audio processing chain 102 is comprised. In general, it is recognized in this disclosure that the effectiveness of the echo canceler 106 and post filter subsystem 108 may be optimized by taking the reference signals for each from different locations along the audio processing chain (that is, the location from which reference signals of the echo canceler 106 are taken are separated from the location from which the reference signals of the post filter subsystem 108 are taken, by at least one audio processing module).

Figure 3:
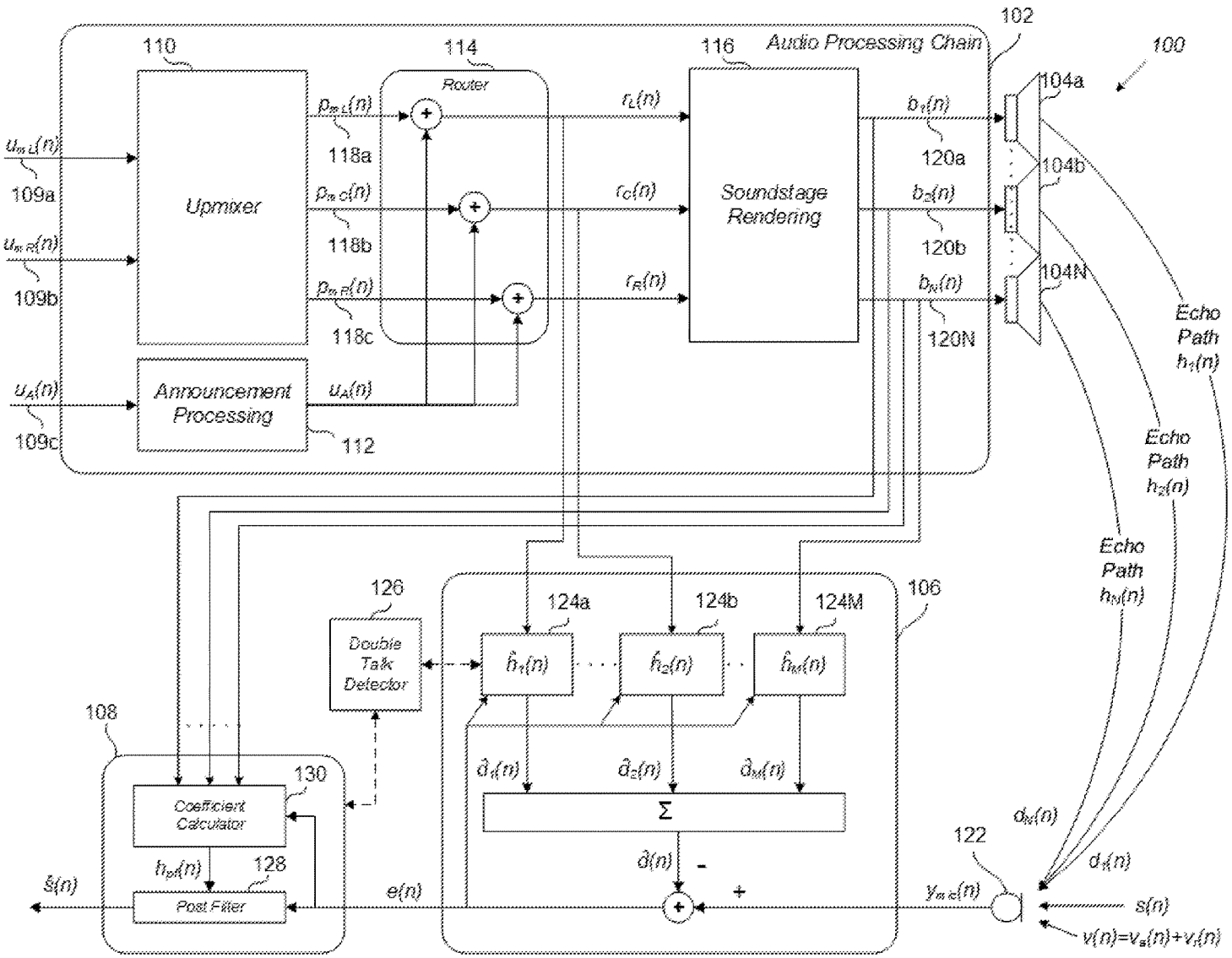
FIG. 3 depicts a schematic of an audio system including an echo canceler and post filter, the echo canceler being referenced to signals taken at different locations of an audio processing chain, according to an example.

In an alternative example, the reference signals of one or both of the echo canceler 106 and/or the post filter subsystem 108 may be taken from different locations along the audio processing chain 102. Stated differently, the references signals for one or both of echo canceler 106 and post filter 108 may be taken from locations that are separated by at least one audio processing module. For example, as shown in FIG. 3, one reference signal of the echo canceler 106 may be taken from the router output signals r(n) and the other reference signals may be taken from the audio system output signals b(n). Thus, the locations from which the reference signals are taken are split between different locations of the audio processing chain 102. It may be advantageous to split the locations from which the reference signals are taken in a number of situations. For example, if a particular signal or set of signals is more likely to cause an echo than a different set of signals, the signals more likely to cause the echo may be taken farther down the audio processing chain 102 (e.g., audio system output b(n)), to more effectively cancel the signals more likely to cause echo, while the signal less likely to cause an echo may be taken earlier (e.g., router output r(n)) where there are generally fewer signals, in order to improve time to convergence.

Figure 4:
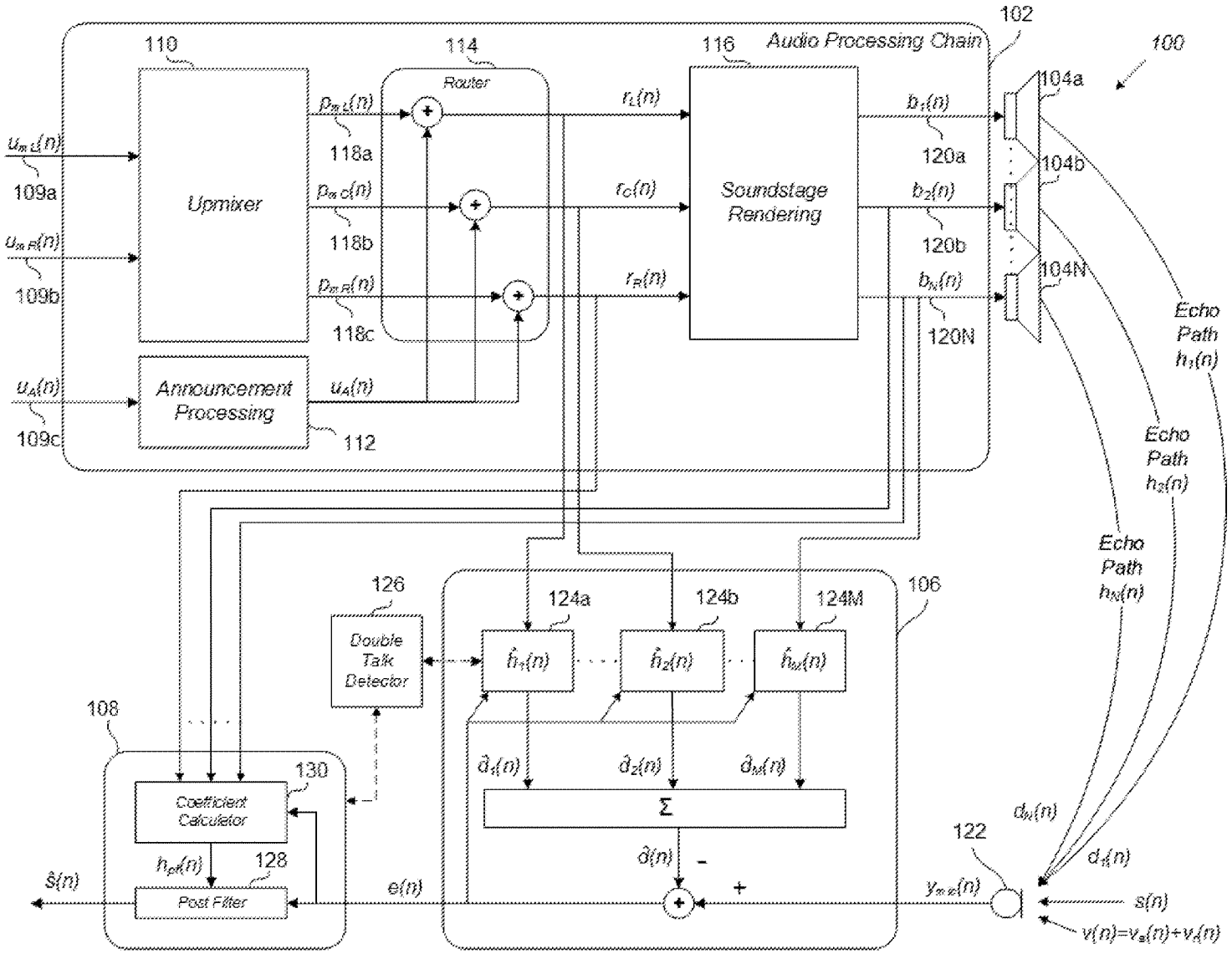
FIG. 4 depicts a schematic of an audio system including an echo canceler and post filter, each being referenced to signals taken at different locations of an audio processing chain, according to an example.

FIG. 4 depicts an example in which the reference signals for the echo canceler 106 and the post filter subsystem 108 receive reference signals taken from separated locations along the audio processing chain 102. It should be understood that the any number of reference signals may be taken from any number of locations along the audio processing chain 102 for each or only one of the echo canceler 106 or post filter subsystem 108, as is suitable for the particular audio processing chain 102 implemented.

Figure 5:
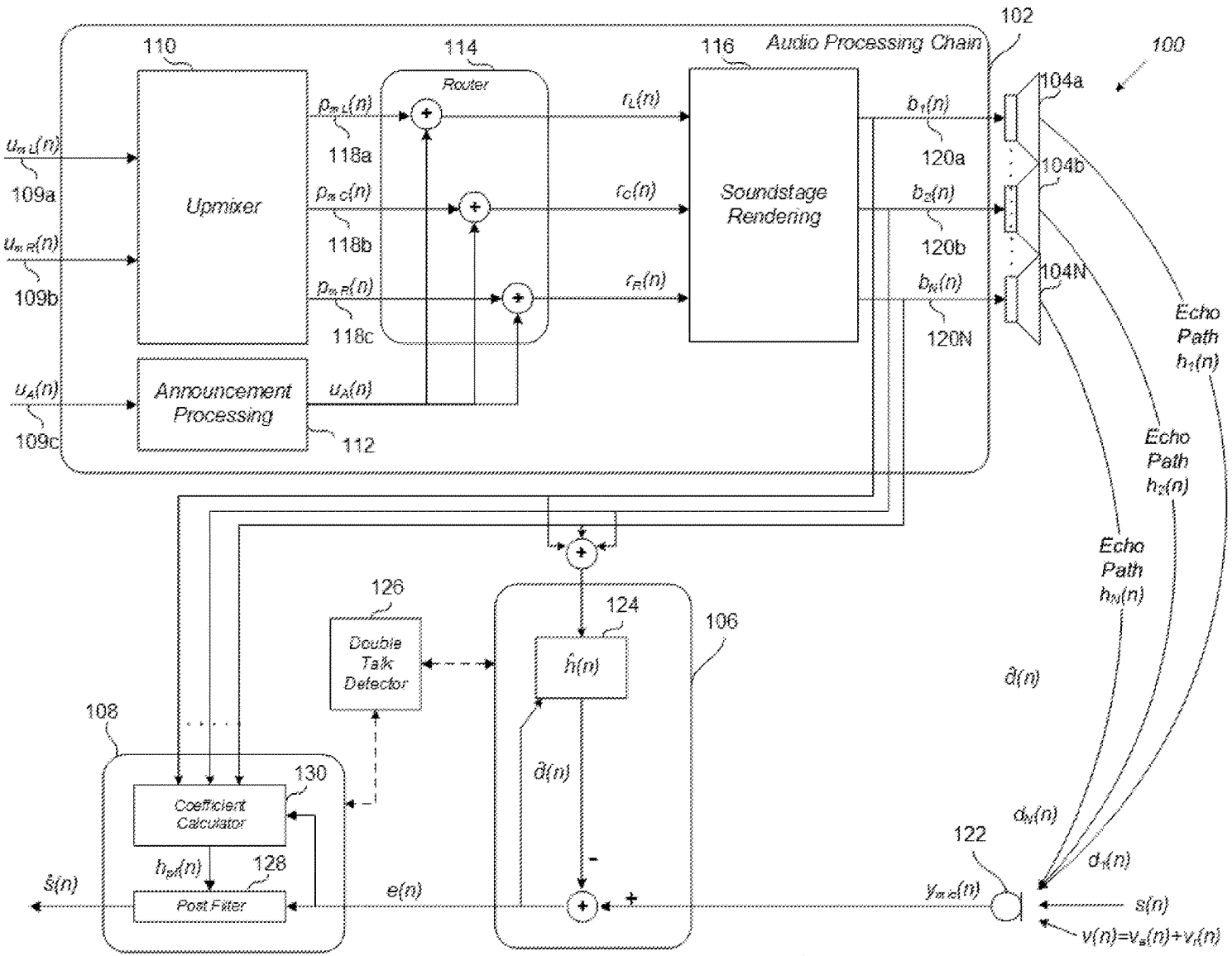
FIG. 5 depicts a schematic of an audio system including an echo canceler and post filter, the echo canceler receiving a reference signal that is a summation of signals of an audio processing chain, according to an example.

In another example, the reference signals may be summed together to generate a summed reference signal for one or both of the echo canceler 106 or post filter subsystem 108, as a way to reduce the number of input reference signals, and thus, time to converge. For example, as shown in FIG. 5, the audio system output signals b(n) are summed together to generate a single reference signal input to echo canceler 106. Thus, instead of N reference signals from N output signals b(n), one reference signal is input to echo canceler 106. Because the echo canceler 106 is receiving one, rather than N reference signals, the time to convergence for the echo canceler 106 will be greatly diminished.

This may, however, come at a cost of effectiveness, depending on the nature of the signals summed. For example, if the signals summed are portions of the same signal broken out between frequency bands—e.g., the same signal which is broken out for a subwoofer, a twiddler, and a tweeter—the signals may be summed together with minimal penalty to effectiveness. However, if the summed signals are not broken out across multiple frequency bands, there will be some reduction in effectiveness. Accordingly, in order to maximize the effectiveness of echo canceler 106 or post filter subsystem 108, the signals summed may be grouped to avoid, or to minimize, summing together signals existing within the same frequency band. For example, one group of frequency sub-banded signals (e.g., a left subwoofer signal, a left twiddler signal, and a left tweeter signal) and another group of frequency sub-banded signals (e.g., a right subwoofer signal, a right twiddler signal, and a right tweeter signal) may be summed together to yield two reference signals, rather than six reference signals, without any frequency overlap between the signals. Furthermore, one or both the echo canceler 106 may receive one reference signal which is a summation of multiple signals, in addition to one or more reference signals which are not summed with any other signals. As shown in FIG. 5 the post filter subsystem 108 may, likewise, receive signals that are summed together.

It should be understood that which signals are summed, and from which location in the audio processing chain those signals are taken, will depend on the specific context of the audio processing chain 102, and, accordingly, the nature of the signals it produces.

The summation, as described in connection with FIG. 6, occurs outside of the audio processing chain 102. That is to say, the summation, output to one or both of the echo canceler 106 or post filter subsystem 108 is not also received at an audio processing module of the audio processing chain 102 and is not output to acoustic transducers 104. This is to distinguish the concept of summing together signals to generate a reference signal, with selecting an advantageous reference signal from the audio processing chain 102 that includes some upstream summation.

Figure 6:
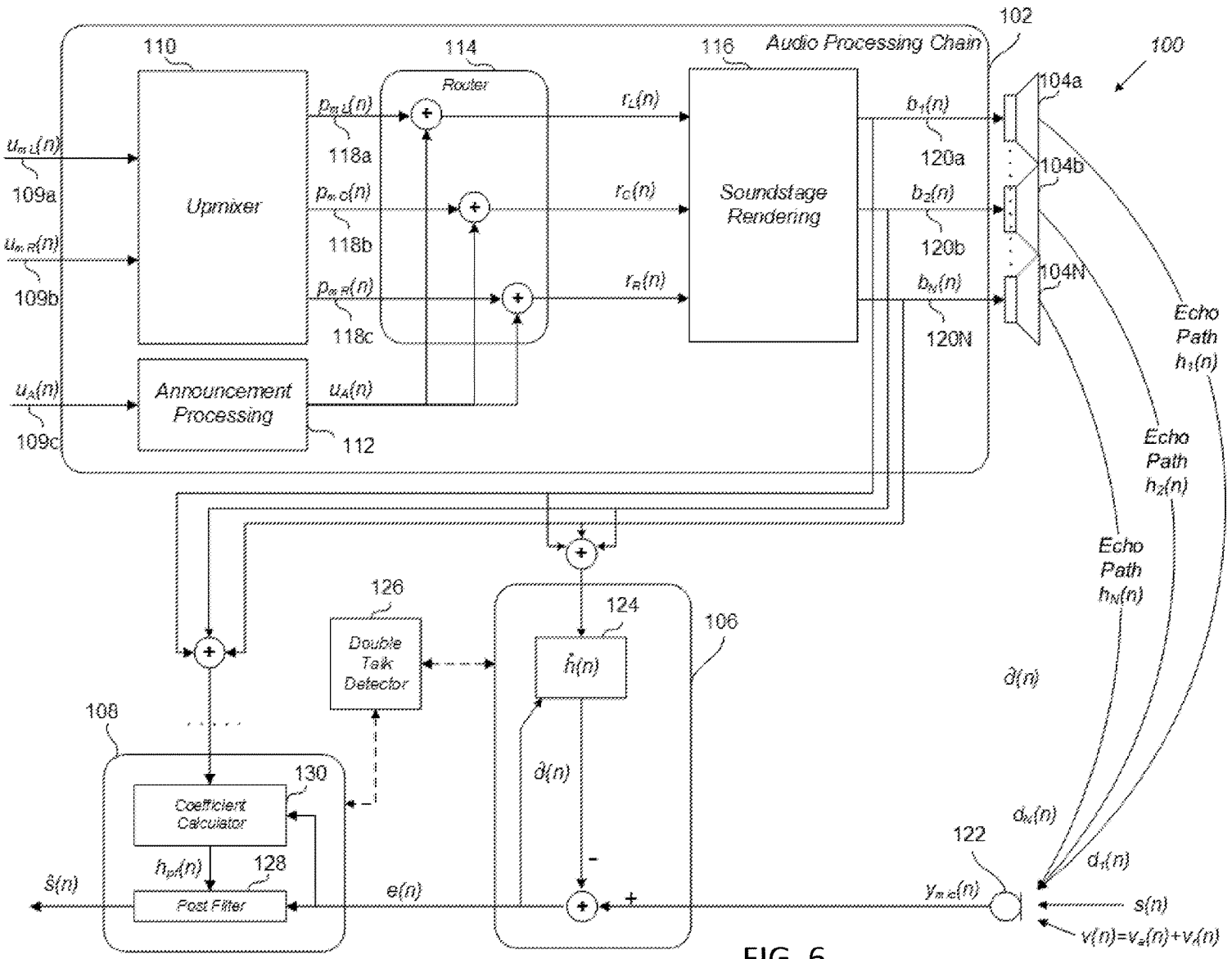
FIG. 6 depicts a schematic of an audio system including an echo canceler and post filter, each receiving a reference signal that is a summation of signals of an audio processing chain, according to an example.
Figure 7:
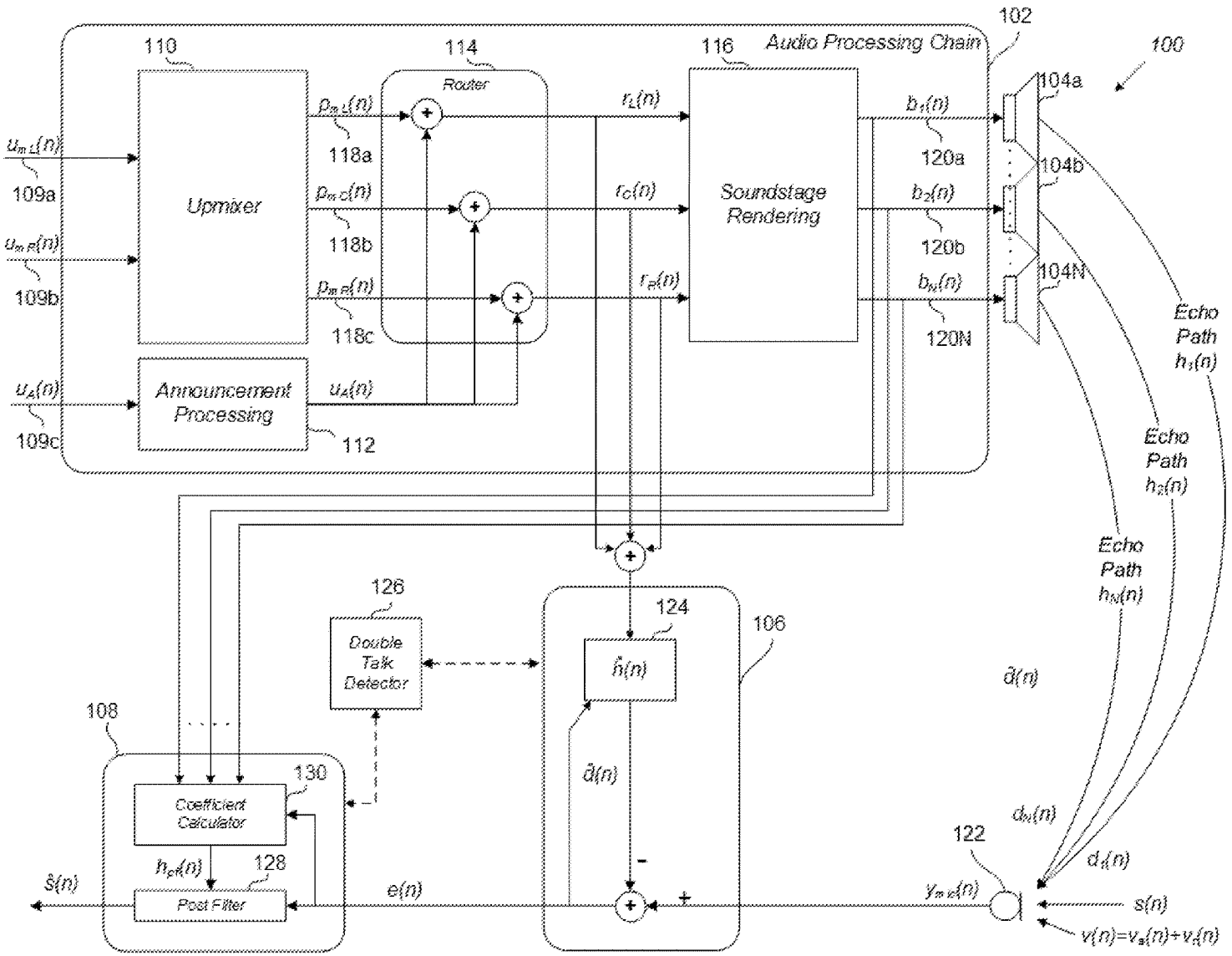
FIG. 7 depicts a schematic of an audio system including an echo canceler and post filter, the echo canceler receiving a reference signal that is a summation of signals of an audio processing chain, the echo canceler and the post filter being referenced to signals taken at different locations of the audio processing chain, according to an example.
Figure 8:
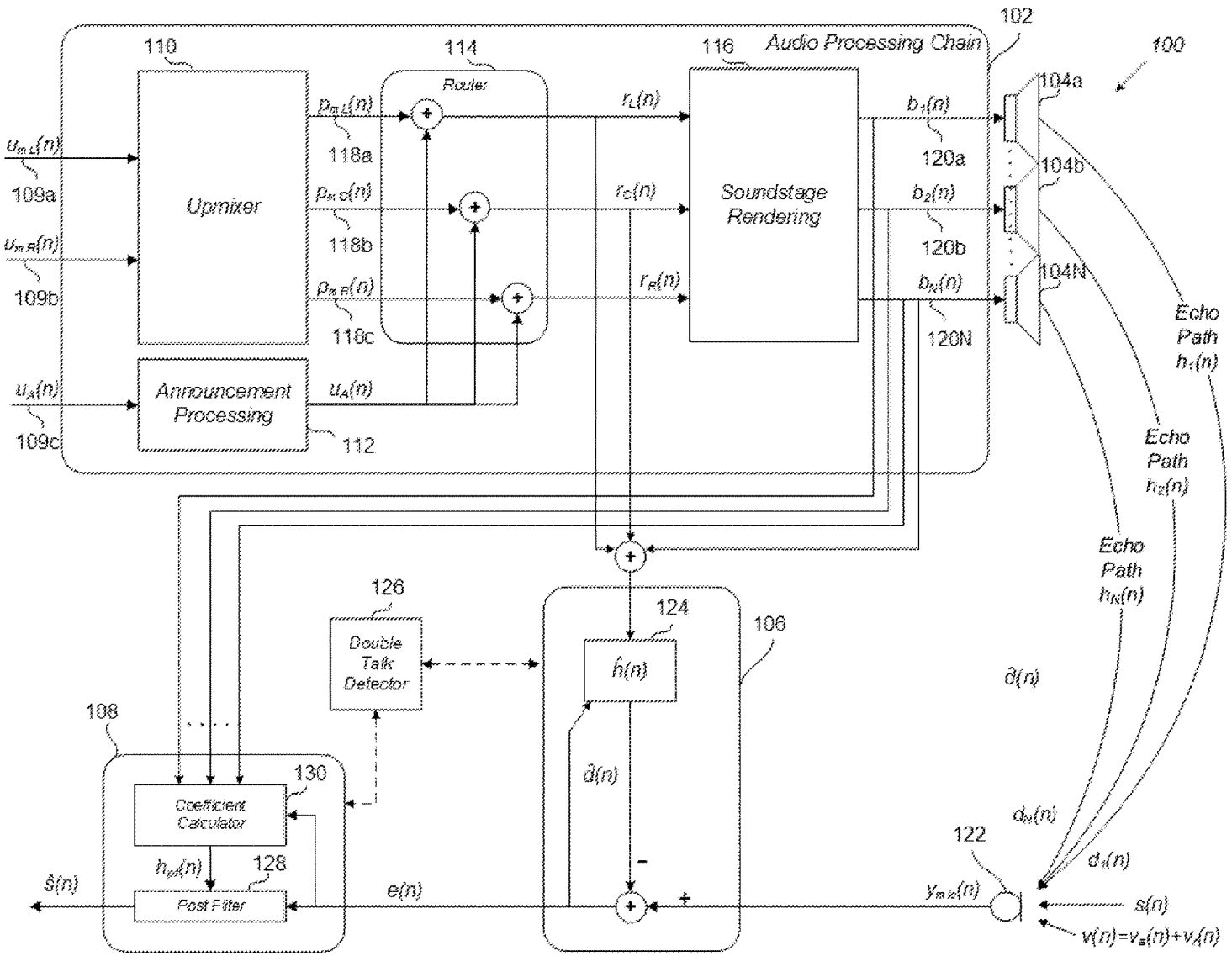
FIG. 8 depicts a schematic of an audio system including an echo canceler and post filter, the echo canceler receiving a reference signal that is a summation of signals taken at different locations of the audio processing chain, according to an example.

Furthermore, it should be understood that the examples of FIGS. 1-4 may be combined with the examples of FIGS. 5-6. For example, one or both of echo canceler 106 or post filter subsystem 108 may receive a summed reference signal, and the echo canceler 106 and post filter subsystem 108 may receive signals taken from different locations along the audio processing chain. For example, as shown in FIG. 7, echo canceler 106 may receive a summed reference signal taken from the router output r(n), while post filter subsystem 108 may receive a summed reference signal (or a reference signal not summed with any other signal) taken from the audio system output b(n). Similarly, combining the examples of FIGS. 3-4 with the examples of FIGS. 5-6, the summed signals may be taken from different locations along the audio processing chain. For example, as shown in FIG. 8, a plurality of signals summed to generate the reference signal for the echo canceler 106 may be taken from router output r(n) and from audio system output b(n). It should be understood that the examples of FIGS. 1-8 may be combined in various other ways to optimize the audio system, in order to effectively cancel echo present in the microphone signal.

The operation of one example of echo canceler 106 and post filter subsystem 108, while generally known, will now be briefly discussed. The echo canceler 106 functions to attempt to remove the echo signal d(n) from the microphone signal y(n) to provide a residual signal e(n). The echo canceler 106 generally works to minimize the echo signal d(n) by processing the reference signals through one or more echo-cancellation filters 124 (multiple echo-cancellation filters together forming a multichannel echo-cancellation filter) to produce an estimated echo signal d(n) which is subtracted from the signal y(n) provided by the microphone (s) 122.

The echo canceler 106 may include an adaptive algorithm to update the echo-cancellation filters 124, at intervals, to improve the estimated echo signal a(n). Over time, the adaptive algorithm causes the echo-cancellation filters 124 to converge on satisfactory parameters that produce a sufficiently accurate estimated echo signal a(n). Generally, the adaptive algorithm updates the echo-cancellation filters 124 during times when the user is not speaking, but in some examples the adaptive algorithm may make updates at any time. When the user speaks, such is deemed "double talk," and the microphone(s) 122 picks up both the acoustic echo signal d(n) and the acoustic voice signal s(n). Double talk may be detected by double talk detector 126, according to any suitable method.

The echo-cancellation filters 124 may apply a set of filter coefficients to the reference signal(s) to produce the estimated echo signal a(n). The adaptive algorithm may use any of various techniques to determine the filter coefficients and to update, or change, the filter coefficients to improve performance of the echo-cancellation filters 124. Such adaptive algorithms, whether operating on an active filter or a background filter, may include, for example, a least mean squares (LMS) algorithm, a normalized least mean squares (NLMS) algorithm, a recursive least square (RLS) algorithm, or any combination or variation of these or other algorithms. The echo-cancellation filters 124, as adapted by the adaptive algorithm, converge to apply an estimated transfer function h(n), which is representative of the echo path between acoustic transducer(s) 104 and microphone(s) 122 (as well as any intervening processing, as will be discussed below). The respective transfer function of each adaptive echo-cancellation filter 124 is adjusted to minimize an error signal, shown here as echo canceled, residual signal e(n).

It should be understood that the number of adaptive echo-cancellation filters 124 will be dependent, generally, on the number of reference signals received. Thus, if the program content signals u(n) are used as reference signals, some number of echo-cancellation filters 124 equal to the number of program content signals u(n) may be implemented, each echo-cancellation filter 124 being respectively associated with one of program content signals u(n); whereas, if the soundstage rendering output b(n), is used, some N number of echo-cancellation filters 124 may be implemented, each echo-cancellation filter 124 being respectively associated with one of N soundstage rendering outputs b(n). It should also be understood that, in some examples, a fewer number of adaptive echo-cancellation filters 124 than, e.g., program content signals u(n) or soundstage rendering outputs b(n), may be used. For example, fewer echo-cancellation filters 124 may be used if certain program content signals u(n), such as a set of woofer left, twiddler left, and twitter left signals, are summed together and provided as a reference signal to a single echo-cancellation filter 124, or if only a subset of reference signals need to be used to achieve effective echo cancellation.

In addition to estimating the echo path(s) h(n), estimated transfer function h(n) may represent an estimate of any processing disposed between the location from which the reference signals (e.g., program content signals u(n)) are taken and echo canceler 106. Thus, where, as shown in FIG. 2, the reference signals are program content signals u(n), the estimated transfer function h(n) will represent the response of upmixer 110, router 114, soundstage rendering 116, acoustic transducer(s) 104, microphone(s) 122, and any processing (such as array processing) associated with microphone(s) 122, in addition to the response of the echo path h(n). The estimated transfer function h(n) is thus a representation of how the reference signals are transformed from their received form into the echo signal d(n), in conjunction with the response and any processing performed at microphone 122. If, by contrast, the reference signals are taken at the output of soundstage rendering 116, b(n), the estimated transfer function h(n) will collectively represent the response of acoustic transducer(s) 104, echo path h(n), microphone(s) 122, and any processing associated with microphone(s) 122. Although, FIG. 1, for example, depicts three estimated echo signals d(n) rather than N estimated echo signals d(n), because the response of soundstage rendering 116 is included in estimated transfer function h(n), each of estimated echo signals d(n) will include the processing of the associated program content signal u(n) by the audio processing modules. Accordingly, the sum of the estimated echo signals d(n) will estimate the sum of N echo signals d(n).

While the echo canceler 106 cancels linear aspects of the microphone signal y(n) correlated to the reference signals, rapid changes and/or non-linearities in the echo path prevent the echo canceler 106 from providing a precise estimated echo signal d(n), and a residual echo will thus remain in the residual signal e(n). The post filter subsystem 108 thus operates to suppress the residual echo component with spectral filtering to produce an improved estimated voice signal s(n). Such post filters are generally known in the art, however a brief description of one example will be provided below.

The post filter subsystem 108 comprises a post filter 128 and a coefficient calculator 130. The post filter 128 suppresses residual echo in the residual signal (from the echo canceler 106) by, in some examples, reducing the spectral content of the residual signal e(n) by an amount related to the likely ratio of the residual echo signal power relative to the total signal power (e.g., speech and residual echo), by frequency bin. In one example, the post filter 128 may multiply each frequency bin (represented by index "k") of the residual signal e(n) by a filter coefficient $H_{pf}(k)$, calculated by coefficient calculator 130, according to the following example equation:

$$H_{pf}(k) = \max\left\{1 - \beta\frac{\sum_{i=1}^{M}[|\Delta H_i(k)|^2 \cdot S_{u_i u_i}(k)]}{S_{ee}(k) + \rho}, H_{min}\right\} \tag{1}$$

where $\Delta H_i(k)$ is a spectral mismatch, $S_{ee}(k)$ is the power spectral density of the residual signal, and $S_{u_i u_i}$ is the power spectral density of the i-th reference signal of M reference signals (the value of M will be dictated by which reference signals are used, as described above). Note that the summation is across all reference signals. A minimum multiplier, $H_{min}$, is applied to every frequency bin, thereby ensuring that no frequency bin is multiplied by less than the minimum. It should be understood that multiplying by lower values is equivalent to greater attenuation. It should also be noted that in the example of Equation (1), each frequency bin is at most multiplied by unity, but other examples may use different approaches to calculate filter coefficients. The R factor is a scaling or overestimation factor that may be used to adjust how aggressively the post filter 128 suppresses signal content, or in some examples may be effectively removed by being equal to unity. The p factor is a regularization factor to avoid division by zero.

The spectral mismatch $\Delta H_i(k)$ represents the spectral mismatch between the actual echo path and the acoustic echo canceler 106. The actual echo path is, for example, the entire path taken by the reference signal from the location from which it is provided to the echo canceler 106, through any intervening processing modules, the acoustic transducer (s) 104, the acoustic environment, and through the microphone(s) 122. The actual echo path may further include processing by the microphone(s) 122 or other supporting components, such as array processing, for example. The spectral mismatch $\Delta H_i(k)$ may be calculated as a ratio of the cross-power spectral density of the i-th reference signal and the residual signal e(n), $S_{u_i e}$, to the power spectral density of the i-th reference signal $S_{u_i u_i}$ $$\Delta H_i = \frac{S_{u_i e}}{S_{u_i u_i}} \tag{2}$$

In some examples, the power spectral densities used may be time-averaged or otherwise smoothed or low pass filtered to prevent sudden changes (e.g., rapid or significant changes) in the calculated spectral mismatch.

It should be understood that Eqs. (1) and (2) are generally related to the case in which reference signals are uncorrelated. If the reference signals are not necessarily uncorrelated (e.g., a left and right channel pair share some common content), the coefficient calculator 130 may calculate the filter coefficient $H_{pf}(k)$ according to the following equation:

$$H_{pf}(k) = \max\left\{1 - \beta\frac{\Delta H^H(k) \cdot S_{uu}(k) \cdot \Delta H(k)}{S_{ee}(k) + \rho}, H_{min}\right\} \tag{3}$$

where $\Delta H^H$ represents the Hermitian of ΔH, which is the complex conjugate transpose of ΔH, and where ΔH is given by:

$$\Delta H = S_{uu}^{-1} S_{ue} \quad (4)$$

$S_{uu}$ is the matrix of power spectral densities and cross power spectral densities of the reference signals. ΔH is the vector containing the spectral mismatch of all channels, and $S_{ue}$ is the vector containing the cross power spectral densities of each reference channel with the residual signal e(n).

Although the above equations have been provided for a post filter 128 configured to suppress residual echo from multiple reference signals, in alternate examples, the post filter 128 may be configured to suppress the residual echo from only one reference signal.

In various examples, the post filter 128 may be configured to operate in the frequency domain or the time domain. Accordingly, use of the term "filter coefficient" is not intended to limit the post filter 128 to operation in the time domain. The terms "filter coefficients," or other comparable terms, may refer to any set of values applied to or incorporated into a filter to cause a desired response or a desired transfer function. In certain examples, the post filter 128 may be a digital frequency domain filter that operates on a digital version of the estimated voice signal to multiply signal content within a number of individual frequency bins, by distinct values generally less than or equal to unity. The set of distinct values may be deemed filter coefficients.

Both the echo canceler 106 and the post filter subsystem 108 may be configured to calculate the echo-cancellation filter 124 coefficients and the post filter 128 coefficients, respectively, only during periods when a double talk condition is not detected, e.g., by a double talk detector 126. As described above, when a user is speaking within the acoustic environment of the audio system 100, the microphone signal y(n) includes a component that is the user's speech. In this case, the combined signal y(n) is not representative of only the echo from the acoustic transducers 104, and the residual signal e(n) is not representative of the residual echo, e.g., the mismatch of the echo canceler 106 relative to the actual echo path, because the user is speaking. Accordingly, the double talk detector 126 operates to indicate when double talk is detected, new coefficients may not be calculated during this period, and the coefficients in effect at the start or just prior to the user talking may be used while the user is talking. The double talk detector 126 may be any suitable system, component, algorithm, or combination thereof.

The output of audio system 100 or any variations thereof (i.e, estimated voice signal s(n)) may be provided to another subsystem or device for various applications and/or processing. Indeed, the audio system 100 output may be provided for any application in which an echo-cancelled voice signal is useful, including, for example, telephonic communication (e.g., providing the output to a far-end recipient via a cellular connection), virtual personal assistants, speech-to-text applications, voice recognition (e.g., identification), or audio recordings.

It should be understood that, in this disclosure, a capital letter used as an identifier or as a subscript represents any number of the structure or signal with which the subscript or identifier is used. Thus, acoustic transducer 104N represents the notion that any number of acoustic transducers 104 may be implemented in various examples. Indeed, in some examples, only one acoustic transducer may be implemented. Likewise, audio system output signal $b_N(n)$ represents the notion that any number of audio system output signals b(n) may be used. It should be understood that, the same letter used for different signals or structures, e.g., soundstage rendering output $b_N(n)$ and echo signals $\hat{d}_N(n)$, represents the general case in which there exists the same number of a particular signal or structure. Thus, in the general case, there will be the same number of soundstage rendering outputs $b_N(n)$ and echo signals $\hat{d}_N(n)$. The general case, however, should not be deemed limiting. A person of ordinary skill in the art will understand, in conjunction with a review of this disclosure, that, in certain examples, a different number of such signals or structures may be used. Furthermore, the absence of a capital letter as an identifier or subscript does not necessarily mean that that the structure or signal or limited to the number of structure of signals shown. Accordingly, although program content signal u(n) is not shown with a capital letter subscript, it should be understood that any number of program content signals may be used.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media or storage device, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random-access memory or both. Components of a computer include a processor for executing instructions and one or more memory devices for storing instructions and data.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the inventive scope of the present disclosure.

What is claimed is:

1. An audio system, comprising:

an echo canceler being configured to receive a first reference signal and a microphone signal, and to minimize an echo signal of the microphone signal, according to the first reference signal, the echo signal being a component of the microphone signal correlated to the first reference signal, to produce a residual signal, wherein the echo signal results from an acoustic signal input to the microphone that is produced by at least one acoustic transducer; and a post filter configured to receive a second reference signal and the residual signal, and to suppress in the residual signal at least one residual component correlated to the second reference signal, according to the second reference signal, to produce an estimated voice signal, wherein the first reference signal is received from a first location of an audio processing chain and the second reference signal is received from a second location of the audio processing chain, the first location and the second location being separated by at least one audio processing module of the audio processing chain, the at least one audio processing module conditioning an input signal for transduction by the at least one acoustic transducer to produce the acoustic signal.

2. The audio system of claim 1, wherein the first reference signal is one of a first plurality of reference signals received by the echo canceler, wherein the second reference signal is one of a second plurality of reference signals received by the post filter, wherein the first plurality of reference signals comprises fewer signals than the second plurality of reference signals.

3. The audio system of claim 1, wherein the first reference signal is one of a plurality of reference signals received by the echo canceler, wherein at least one reference signal of the plurality of reference signals is separated from the first reference signal by at least one processing module of the audio processing chain.

4. The audio system of claim 1, wherein the second reference signal is one of a plurality of reference signals received by the post filter, wherein at least one reference signal of the plurality of reference signals is separated from the second reference signal by at least one processing module of the audio processing chain.

5. The audio system of claim 1, wherein the first reference signal is a summation of a plurality of signals of the audio processing chain, wherein the summation occurs outside of the audio processing chain.

6. The audio system of claim 5, wherein at least one of the plurality of signals is separated from at least one other signal of the plurality of signals by at least one audio processing module of the audio processing chain.

7. The audio system of claim 1, wherein the second reference signal is a summation of a plurality of signals of the audio processing chain, wherein the summation occurs outside of the audio processing chain.

8. The audio system of claim 7, wherein at least one of the plurality of signals is separated from at least one other signal of the plurality of signals by at least one audio processing module of the audio processing chain.

9. A method for cancelling echo in an audio system, comprising:

receiving, at an echo canceler, a first reference signal and a microphone signal;

minimizing, with the echo canceler, an echo signal of the microphone signal, according to the first reference signal, the echo signal being a component of the microphone signal correlated to the first reference signal, to produce a residual signal, wherein the echo signal results from an acoustic signal input to the microphone that is produced by at least one acoustic transducer;

receiving at a post filter, a second reference signal and the residual signal; and suppressing, with the post filter, at least one residual component, in the residual signal, correlated to the second reference signal, according to the second reference signal, to produce an estimated voice signal, wherein the first reference signal is received from a first location of an audio processing chain and the second reference signal is received from a second location of the audio processing chain, the first location and the second location being separated by at least one audio processing module of the audio processing chain, the at least one audio processing module conditioning an input signal for transduction by the at least one acoustic transducer to produce the acoustic signal.

10. The method of claim 9, wherein the first reference signal is one of a first plurality of reference signals received by the echo canceler, wherein the second reference signal is one of a second plurality of reference signals received by the post filter, wherein the first plurality of reference signals comprises fewer signals than the second plurality of reference signals.

11. The method of claim 9, wherein the first reference signal is one of a plurality of reference signals received by the echo canceler, wherein at least one reference signal of the plurality of reference signals is separated from the first reference signal by at least one processing module of the audio processing chain.

12. The method of claim 9, wherein the second reference signal is one of a plurality of reference signals received by the post filter, wherein at least one reference signal of the plurality of reference signals is separated from the second reference signal by at least one processing module of the audio processing chain.

13. The method of claim 9, wherein the first reference signal is a summation of a plurality of signals of the audio processing chain, wherein the summation occurs outside of the audio processing chain.

14. The method of claim 13, wherein at least one of the plurality of signals is separated from at least one other signal of the plurality of signals by at least one audio processing module of the audio processing chain.

15. The method of claim 9, wherein the second reference signal is a summation of a plurality of signals of the audio processing chain, wherein the summation occurs outside of the audio processing chain.

16. The method of claim 15, wherein at least one of the plurality of signals is separated from at least one other signal of the plurality of signals by at least one audio processing module of the audio processing chain.

17. An audio system, comprising:

an echo canceler being configured to receive a first reference signal and a microphone signal, and to minimize an echo signal of the microphone signal, according to the first reference signal, the echo signal being a component of the microphone signal correlated to the first reference signal, to produce a residual signal, wherein the echo signal results from an acoustic signal input to the microphone that is produced by at least one acoustic transducer; and a post filter configured to receive a second reference signal and the residual signal, and to suppress in the residual signal at least one residual component correlated to the second reference signal, according to the second reference signal, to produce an estimated voice signal, wherein at least one of the first reference signal or the second reference signal is a summation of a plurality of signals of an audio processing chain, the plurality of signals being conditioned by the audio processing chain for transduction by the at least one acoustic transducer to produce the acoustic signal, wherein the summation occurs outside of the audio processing chain, wherein at least one signal of the plurality of signals is separated from at least one other of signal of the plurality of signals by at least one audio processing module of the audio processing chain.

18. The audio system of claim 17, wherein the echo canceler receives a plurality of reference signals, wherein at least one reference signal of the plurality of reference signals is separated from at least one other reference signal of the plurality of reference signals by at least one audio processing module of the audio processing chain.

19. The audio system of claim 17, wherein the post filter receives a plurality of reference signals, wherein at least one reference signal of the plurality of reference signals is separated from at least one other reference signal of the plurality of reference signals by at least one audio processing module of the audio processing chain.

* * * * *